US007977558B2

(12) United States Patent
Nakata et al.

(10) Patent No.: US 7,977,558 B2
(45) Date of Patent: Jul. 12, 2011

(54) STRAINER, AND SNAPPY HOLDING STRUCTURE BY THE STRAINER

(75) Inventors: Eizo Nakata, Osaka (JP); Manabu Morioka, Osaka (JP); Takashi Wariishi, Osaka (JP); Shunsaku Tsuji, Osaka (JP)

(73) Assignee: Sakae Rhythm Musical Instrument Ltd., Osaka-Shi (JP)

( * ) Notice: Subject to any disclaimer, the term of this patent is extended or adjusted under 35 U.S.C. 154(b) by 0 days.

(21) Appl. No.: 12/745,113

(22) PCT Filed: Nov. 28, 2008

(86) PCT No.: PCT/JP2008/071652

§ 371 (c)(1),
(2), (4) Date: Oct. 25, 2010

(87) PCT Pub. No.: WO2009/069748

PCT Pub. Date: Jun. 4, 2009

(65) Prior Publication Data

US 2011/0023686 A1 Feb. 3, 2011

(30) Foreign Application Priority Data

Nov. 30, 2007 (JP) ..... 2007-310674
Nov. 27, 2008 (JP) ..... 2008-302266
Nov. 27, 2008 (JP) ..... 2008-302413

(51) Int. Cl.
*G10D 13/02* (2006.01)

(52) U.S. Cl. ..... 84/413; 84/415

(58) Field of Classification Search ..... 84/411 R, 84/413–417

See application file for complete search history.

(56) References Cited

U.S. PATENT DOCUMENTS 7,312,389 B2 * 12/2007 Okamoto ..... 84/415
2006/0266198 A1 11/2006 Jeffries

FOREIGN PATENT DOCUMENTS

| | | |
|---|---|---|
| JP | 57-100793 | 6/1982 |
| JP | 63-33245 | 9/1988 |
| JP | 63-36382 | 9/1988 |
| JP | 4-93889 | 8/1992 |
| JP | 7-39093 | 7/1995 |
| JP | 2002-202774 A1 | 7/2002 |
| JP | 2005-331922 A1 | 12/2005 |

OTHER PUBLICATIONS

International Search Report for International Application No. PCT/JP2008/071652 dated Dec. 18, 2008.

* cited by examiner

*Primary Examiner* — Kimberly R Lockett
(74) *Attorney, Agent, or Firm* — Kratz, Quintos & Hanson, LLP

(57) ABSTRACT

Intended is to provide a strainer having a switch mechanism, which is hardly rattled by a wear, which can be stably operated by a weak force, which does not load a snare assembly and which can maintain an excellent operation feel, and a snare assembly holding structure which has a reliable clamping force so that it can prevent the looseness of the snare assembly end portion. An operation lever is hinged on its base end side to a base body. A link is turnably connected on its one end side to the lower side portion of a snare assembly holding member, and is likewise turnably connected on its other end side to a midway position of the operation lever. When the operation lever turns upward, the snare assembly holding member is pulled upward through the link. When the operation lever turns downward, the snare assembly holding member is pushed downward.

20 Claims, 16 Drawing Sheets

[Fig. 1]
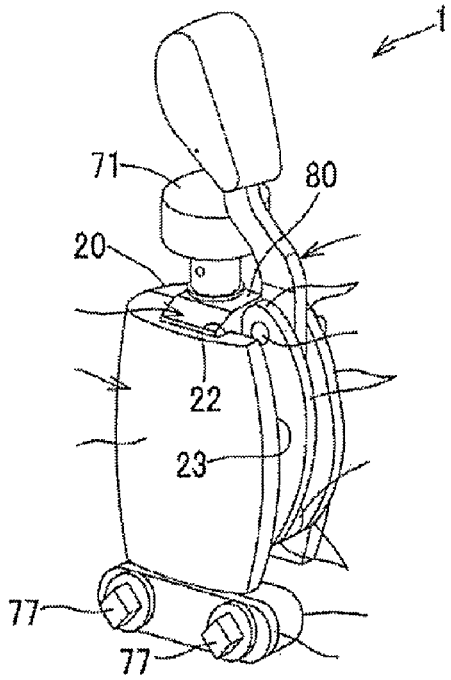
[Fig. 2]
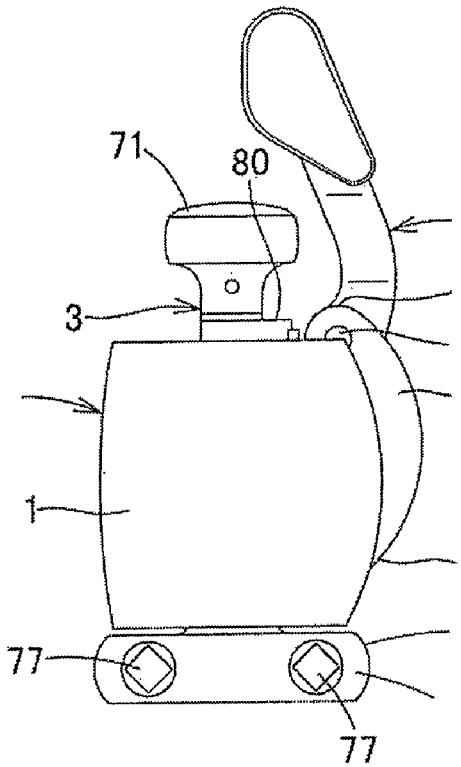

[Fig. 3]
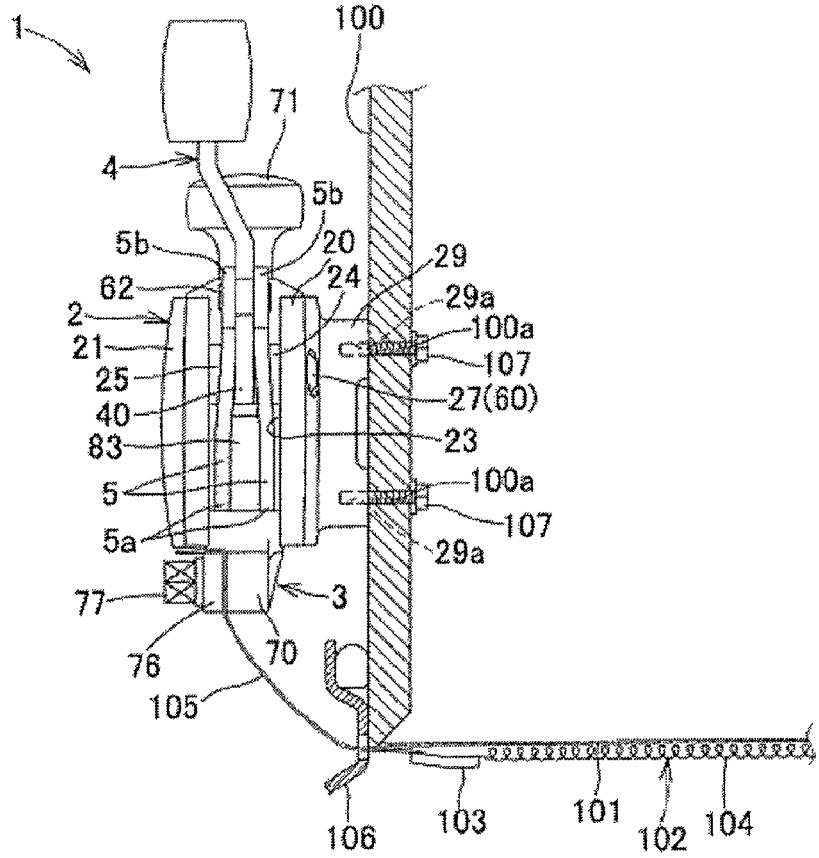
[Fig. 4]
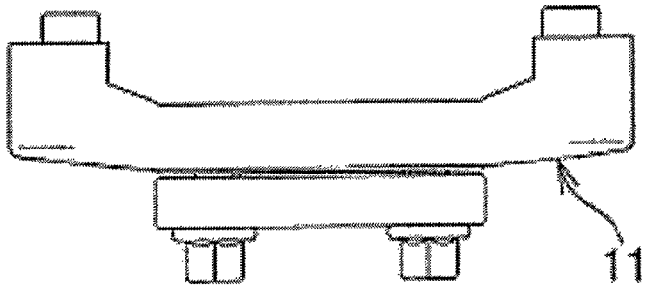

[Fig. 5]
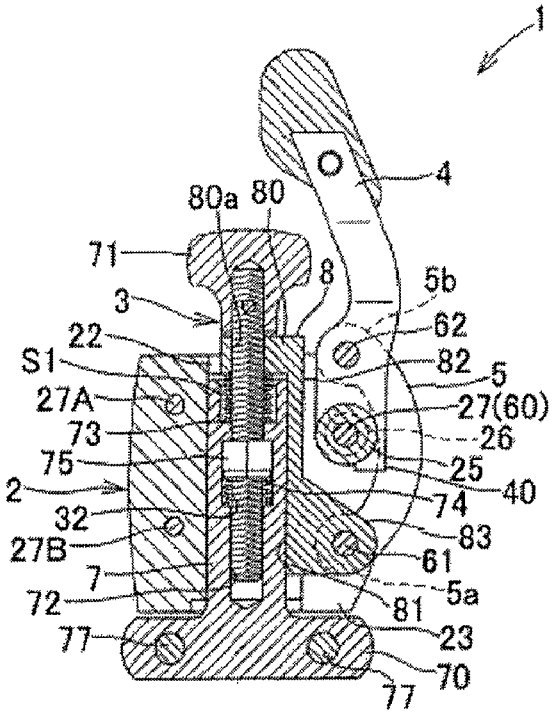
[Fig. 6]
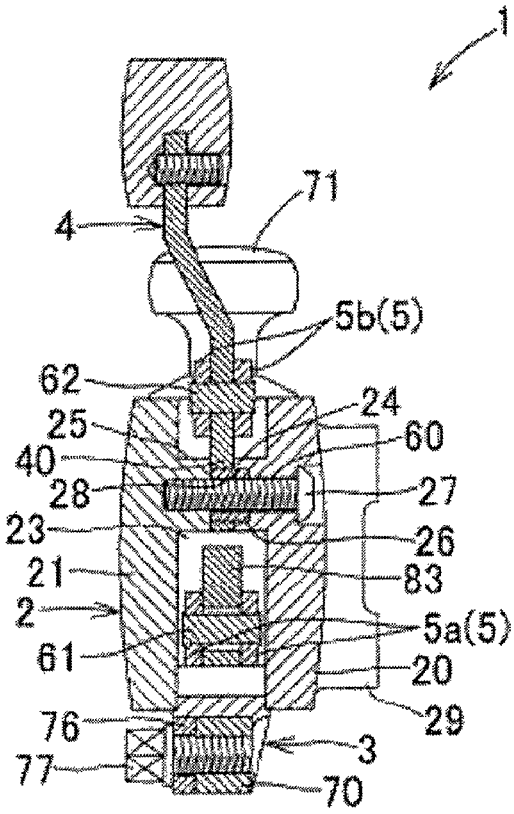

[Fig. 7]
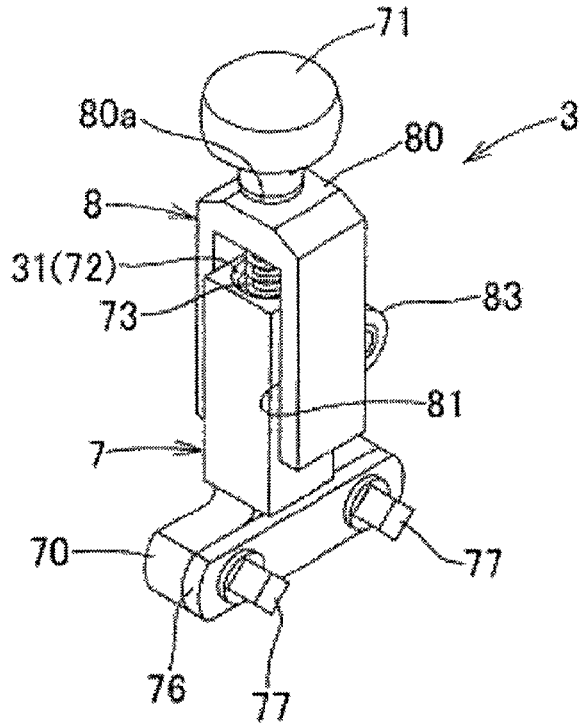
[Fig. 8]
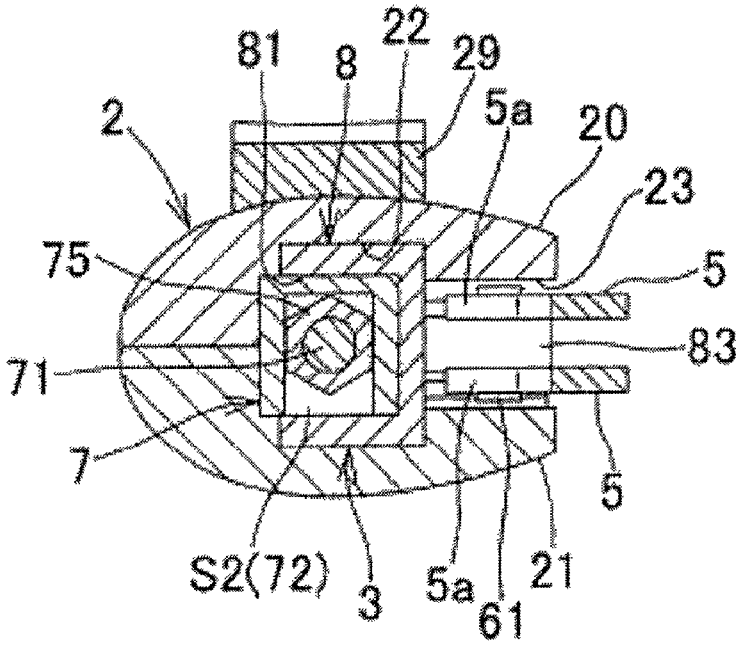

[Fig. 9]
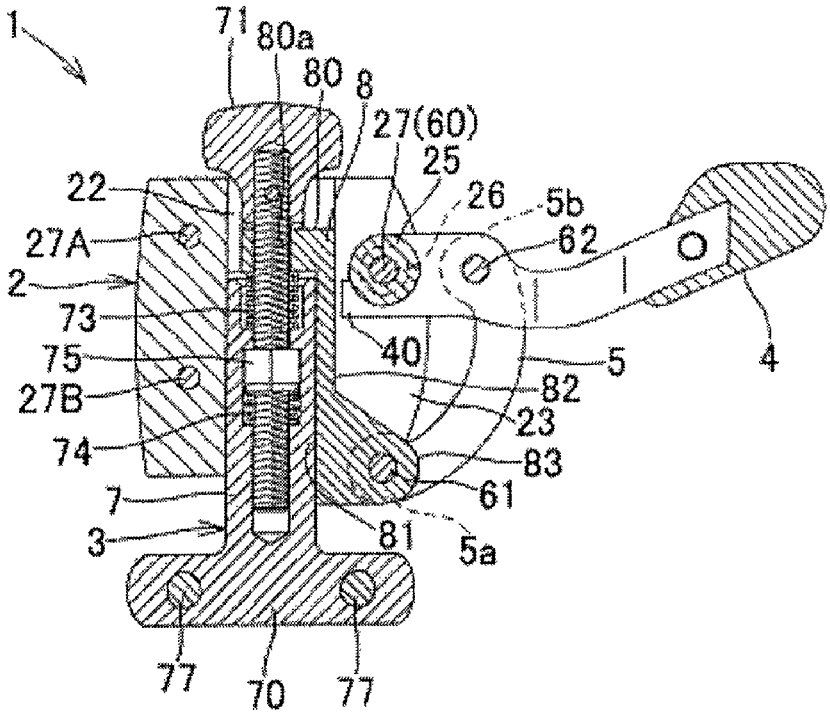

[Fig. 10]
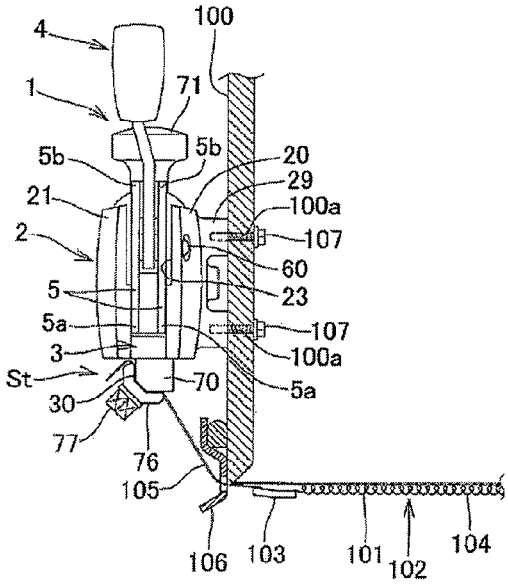
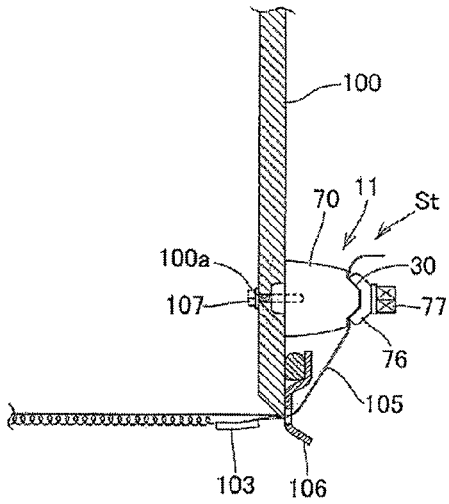

[Fig. 11]
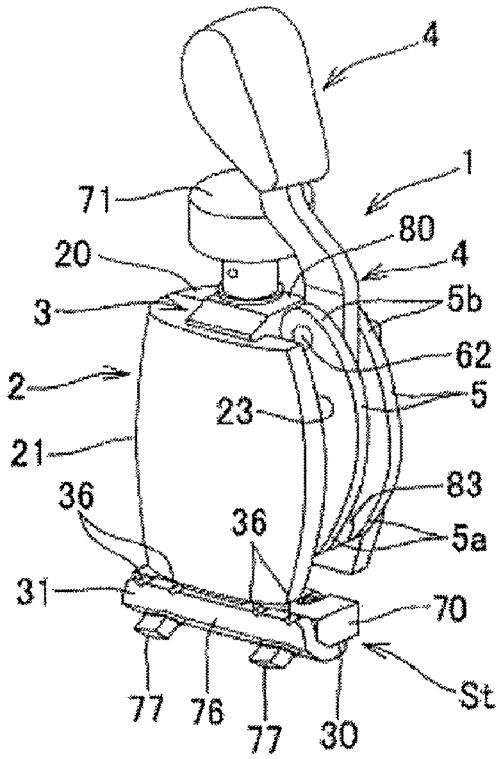
[Fig. 12]
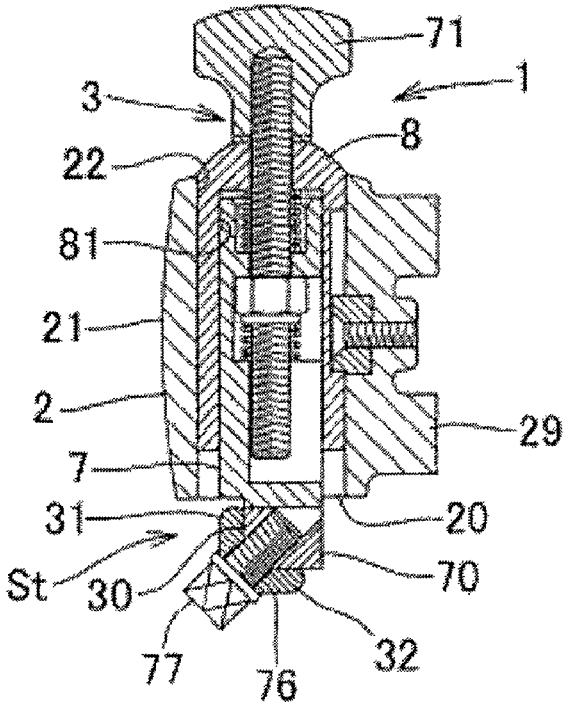

[Fig. 13]
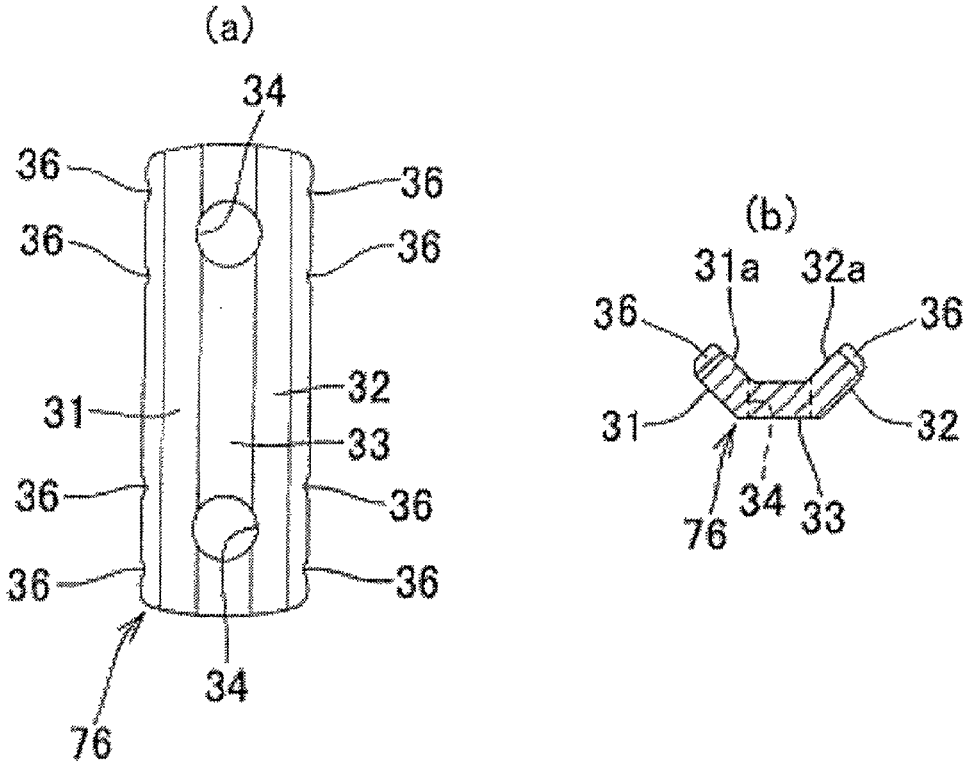

[Fig. 14]
(a)
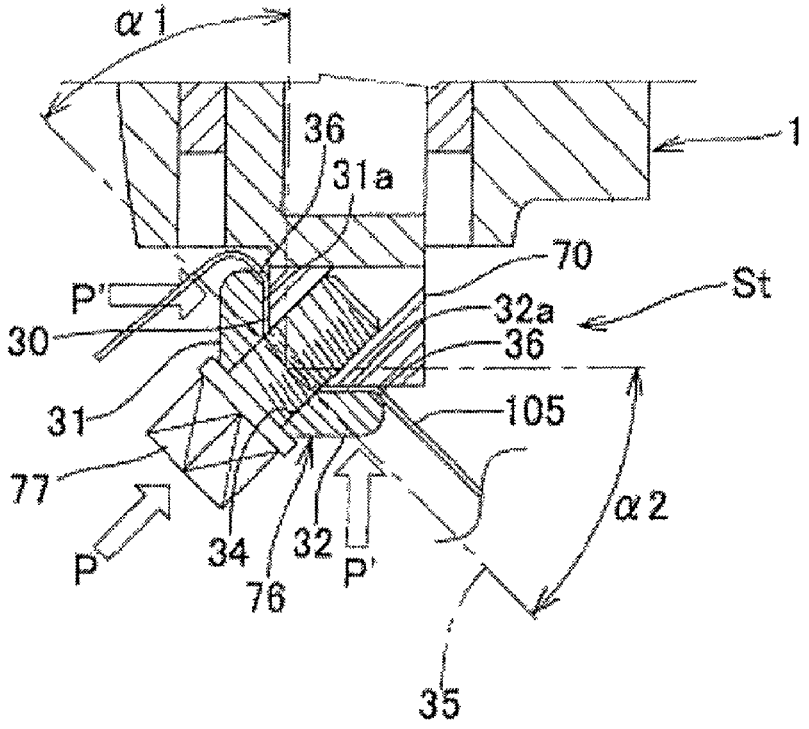
(b)
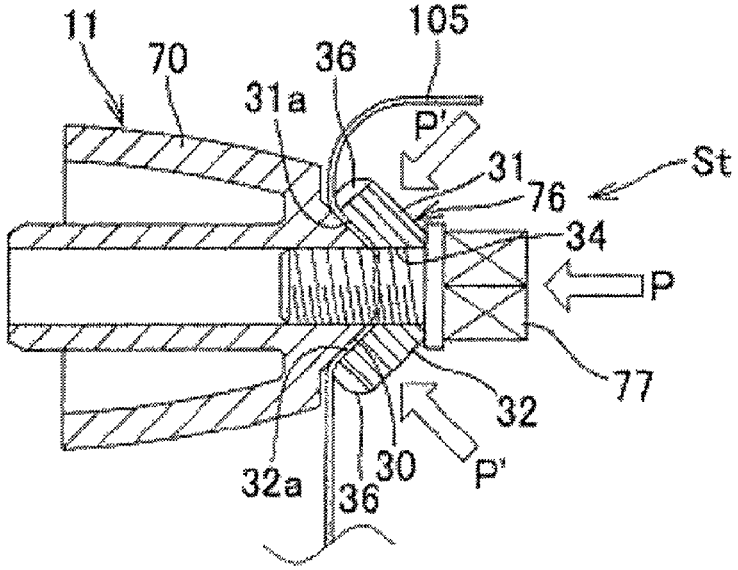

[Fig. 15]
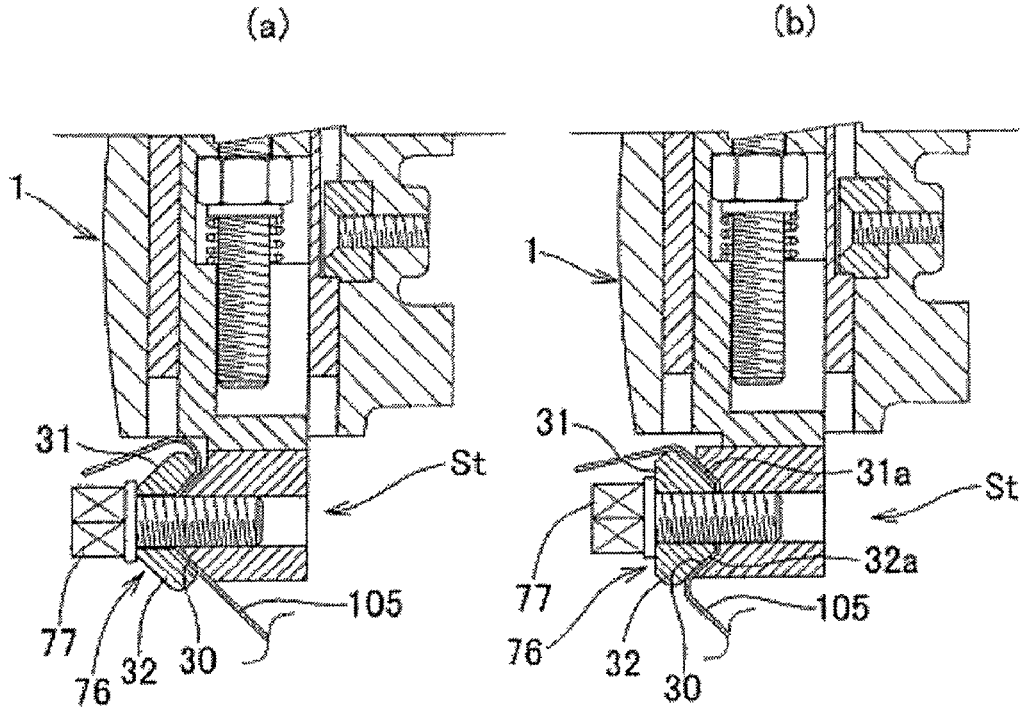

[Fig. 16]
(a)
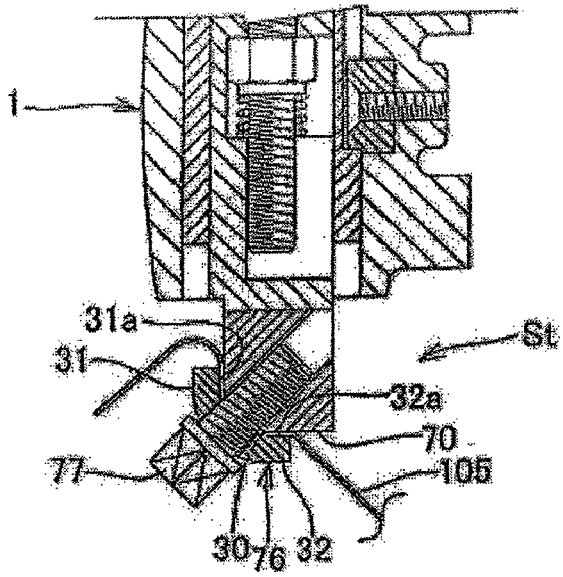
(b)
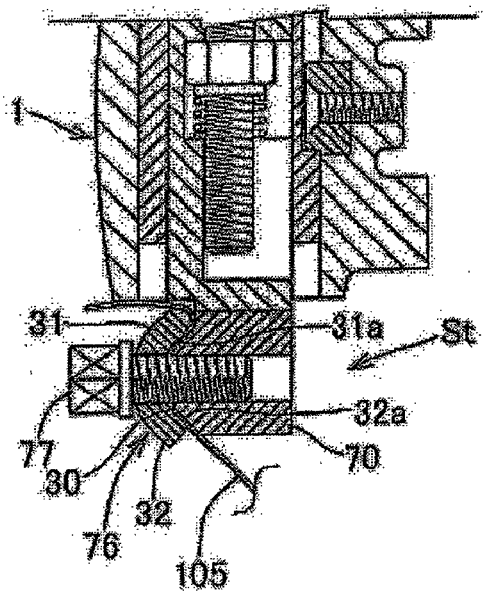
(c)
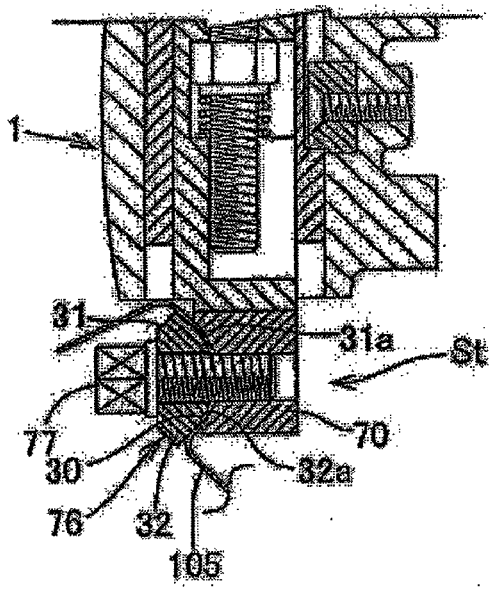

[Fig. 17]
(a)
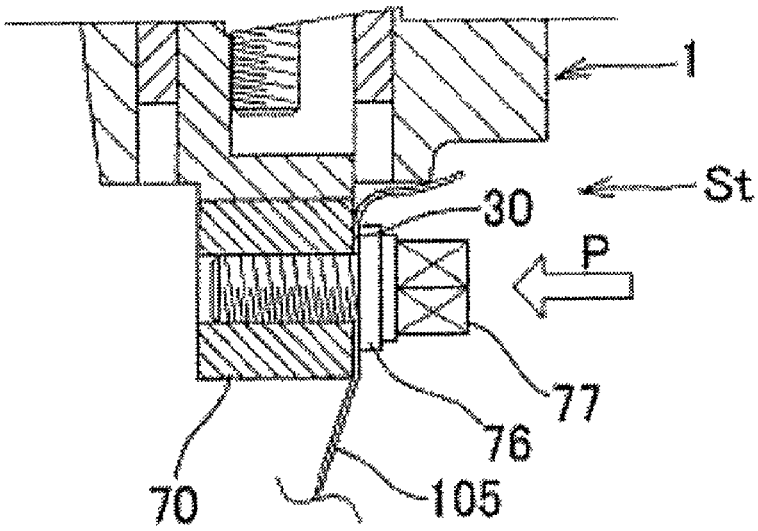
(b)
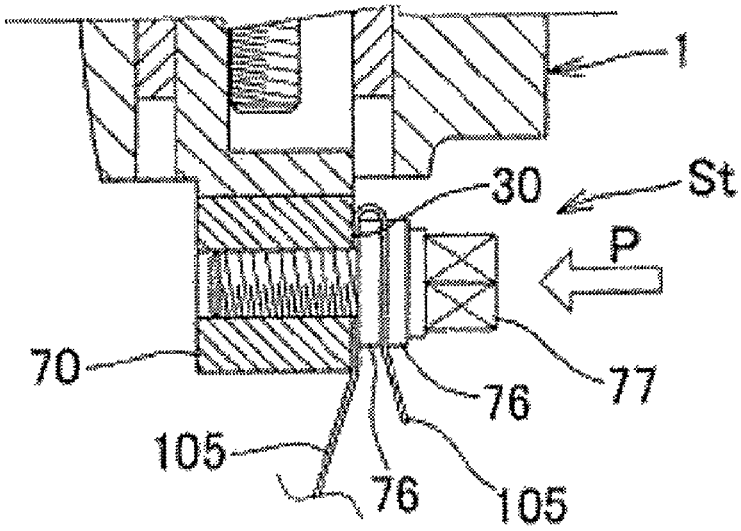

[Fig. 18]
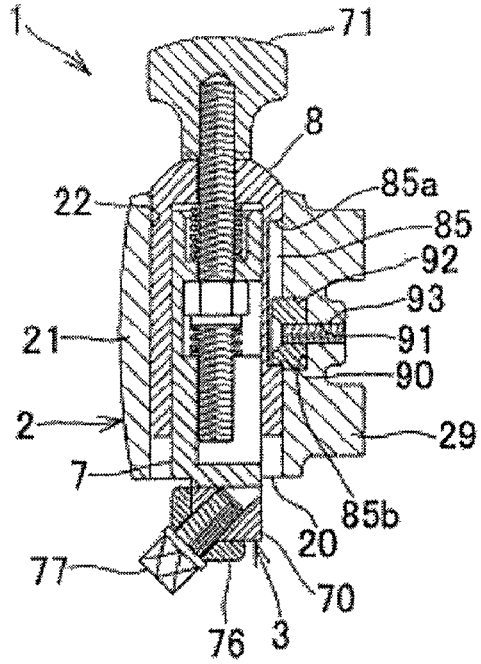
[Fig. 19]
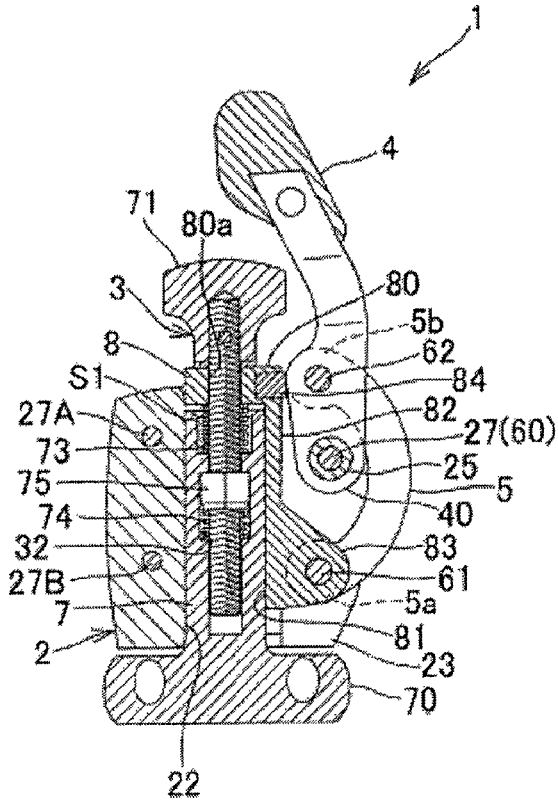

[Fig. 20]
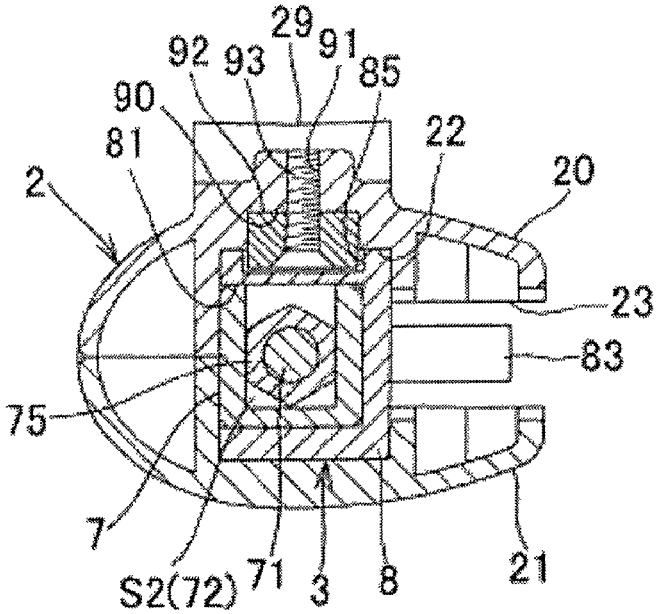
[Fig. 21]
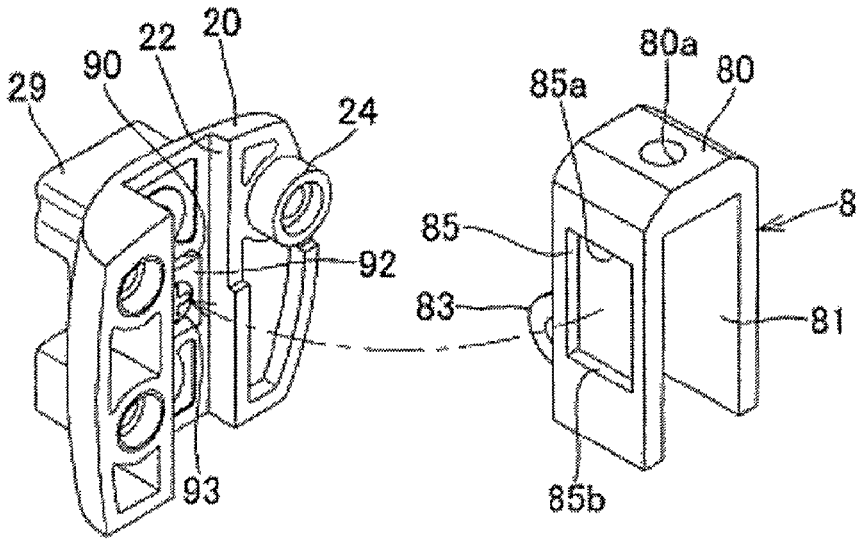

[Fig. 22]
(a)
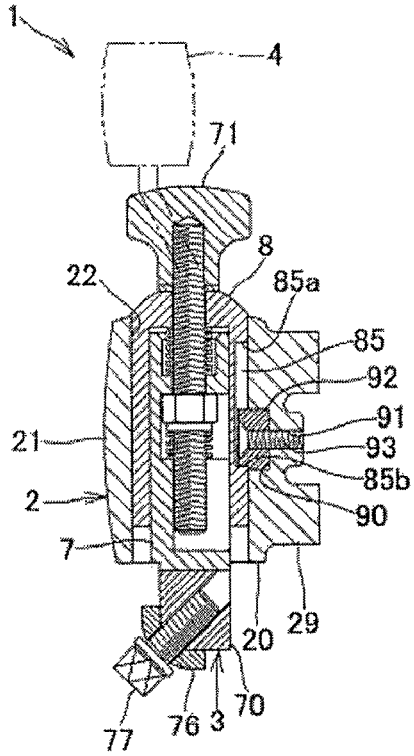
(b)
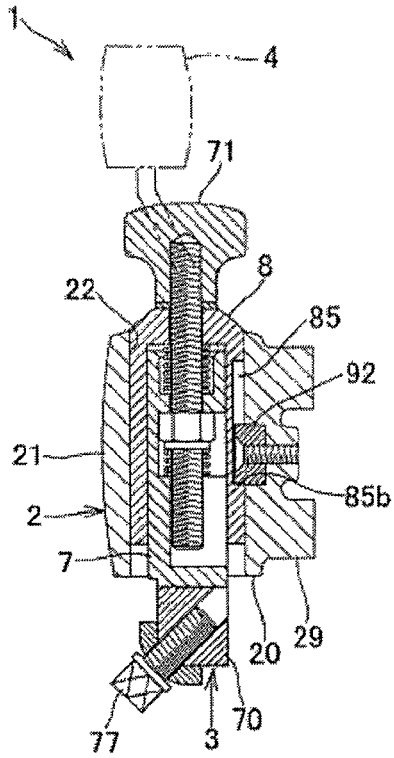

[Fig. 22]
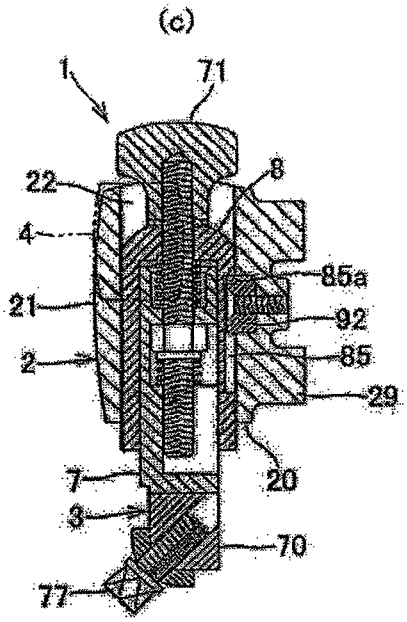

STRAINER, AND SNAPPY HOLDING STRUCTURE BY THE STRAINER

TECHNICAL FIELD

The present invention relates to a strainer for supporting a snare assembly end of a snare drum and for switching a snare assembly between contact/noncontact states relative to a drumhead, and a snare assembly holding structure with the strainer for supporting the snare assembly end on the drum shell body side.

BACKGROUND ART

A snare drum is structured as follows: a top-side drumhead and a bottom-side drumhead are disposed to close both ends of a shell body, having hoops interposed therebetween, respectively. Further, a plurality of head adjustment devices for adjusting tension of the drumheads is disposed at an equal angular interval, so as to connect the top-side hoop and the bottom-side hoop. Strainers located in opposition at positions differing 180° at the shell body hold a snare assembly made up of a plurality of snare wires such that the snare assembly can be switched between a contact/noncontact state with respect to the bottom-side drumhead (for example, see Patent Documents 1 to 3). At least one of the pair of strainers is a strainer equipped with a switch mechanism that allows the snare assembly to switch between the contact/noncontact states by moving up and down the end of the snare assembly being held. The other may also be a similar strainer equipped with a switch mechanism, or it may be a fixed type strainer without such a switch mechanism.

What has conventionally been provided as such a strainer equipped with a switch mechanism is a strainer structured with components such as: a base element fixed at the exterior circumferential surface of a shell body; a snare assembly holding element mounted on the base element so as to be freely movable upward and downward; a switch mechanism that moves forward and backward the snare assembly holding element relative to the base element so as to bring the movable end of the snare assembly into contact or out of contact with a bottom-side drumhead; and a tension adjustment screw that similarly moves forward and backward the snare assembly holding element relative to the base element so as to fine-tune the tension of the snare assembly (for example, see Patent Documents 1 and 2).

In particular, as to such a switch mechanism that moves the snare assembly holding element to switch the snare assembly between the contact/noncontact states, Patent Document 1 proposes a mechanism as a cam mechanism, in which rotation of a switch lever moves a circular cam, and a slide plate goes down with a snare assembly holding element through a cam aperture; and reverse rotation of the switch lever lifts up the slide plate with the snare assembly holding element through the circular cam and the cam aperture. However, such a cam mechanism is prone to suffer from backlash due to wear and the like caused by a concentrated load acting upon a portion around the cam aperture. Such backlash causes a reduction in operation feel. Further, the positional attitude of the cam mechanism in its contact/noncontact states is unstable because of its mechanism, and the movement allowance of the switch lever in its up (contact) state is small. Thus, just a small amount of movement of the lever easily allows a non-contact state to be entered.

Patent Document 2 proposes a mechanism in which a linkage mechanism is employed as the switch mechanism. When a switch is operated upward, a link connected to the rotating switch moves in a direction to push up the shaft of a snare assembly holding element connected to the top end thereof, whereby the snare assembly is caused to enter a contact state indirectly through a slide member. However, the linkage mechanism is configured to push up the link connected to the lever so as to move the snare assembly holding element upward. Therefore, force in diagonal direction acting upon the snare assembly holding element from the shaft at the beginning of push-up is great. Hence, similarly to the above-described cam mechanism, it is prone to suffer from backlash which causes a reduction in operation feel. Furthermore, again, because the force acts in the diagonal direction at the beginning of push-up, the force required for the operation is great, putting a burden upon the player.

Another proposed mechanism is as follows: instead of moving the snare assembly holding element up and down, a stretching rod is provided to a lever member. When a switch lever is rotated clockwise by a prescribed angle, the stretching rod goes down to approach the shell body, whereby a snare assembly connection member is released from a tension state and brought into contact with the rear end of the slope of an arm member. As a result, the snare assembly is released from the tension state and sags under its own weight (see Patent Document 3). However, such a mechanism poses problems of a very complicated structure and an increased burden on the snare assembly string because of the stretching rod directly abutting on the snare assembly string.

Further, as shown in FIG. 17 (*a*), such snare assembly end holding structures with a strainer equipped with a switch mechanism or with a fixed type strainer are each conventionally been structured as follows: a stopper plate 76 is mounted on a snare assembly stopper face 30 of a strainer 1 with a bolt 77, and the bolt 77 is tightened in a state where a snare assembly end 105 is passed through between the snare assembly stopper face 30 and the stopper plate 76, whereby the snare assembly end 105 is clamped therebetween. With such a structure, the axial force obtained by tightening the bolt 77 acts upon the snare assembly end 105 as the clamping force. Accordingly, when the bolt tightening force is weak, the snare assembly end 105 is easily loosened, to adversely affect the musical performance. Therefore, as shown in FIG. 17 (*b*), measures have conventionally been taken to prevent loosening by two pieces of stopper plates 76, such that the snare assembly end 105 having passed through between one of the stopper plates 76 and the stopper face 30 is again passed through between the stopper plates 76, thereby doubling the length of the snare assembly end being clamped. However, such a holding structure involves complicated attaching work of the snare assembly end to the stopper plates, and invites an increase in both costs and total weight because of the increased number of the stopper plate.

A possible structure for preventing loosening with one stopper plate may be to provide a projection or the like at the interior surface of the stopper plate such that the projection meshes with the snare assembly end (for example, see Patent Document 1). However, with such a structure, the clamping force is concentrated to the projection portion, putting a load on a part of the snare assembly end. Therefore, repeated use (in particular, repeated switching operation between contact/noncontact) may break the snare assembly end. Further, with such a single-point concentration type holding structure, the snare assembly end easily break with the slightest excessive bolt tightening force. Hence, the adjustment thereof becomes very delicate work, which gives the player cause for anxiety.

Patent Document 1: JP-A No. 7-39093
Patent Document 2: JP-A No. 2005-331922
Patent Document 3: JP-A No. 2005-227660

DISCLOSURE OF THE INVENTION

Technical Problems To Be Solved

In consideration of the foregoing, the present invention is to solve the problems by providing a strainer equipped with a switch mechanism which have a simple structure and hence achieves a reduction in costs, can easily and stably be operated with small force with little backlash due to wear or the like, and can maintain excellent operation feel without putting burden on the snare assembly. The present invention is to further solve the problems by providing a snare assembly holding structure with which snare assembly end attaching work can easily be carried out using a single stopper plate, possessing firm clamping force to prevent loosening of the snare assembly end, being free of delicate tightening adjustment and braking of the snare assembly end.

Means To Solve the Problems

In order to solve the problems described above, the present invention provides a strainer, including:

a base element that is fixed on a shell body side of a drum;

a snare assembly holding element that is engaged with the base element to freely slide up and down, and that has its bottom end side connected to a snare assembly;

an operating lever that slides up and down the snare assembly holding element relative to the base element, so as to switch the snare assembly between contact and noncontact states relative to a drumhead, characterized in that the strainer further comprises a link that pivotally and rotatably support a pedestal end side of the operating lever on the base element via a shaft portion, the link having its one end rotatably connected to a site located lower than the shaft portion of the operating lever in the snare assembly holding element, the link having its other end also rotatably connected to a midway position away by a prescribed distance toward a tip end from the pedestal end portion of the operating lever, wherein upward rotation of the operating lever lifts up the snare assembly holding element relative to the base element via the link, and downward rotation of the operating lever pushes down the snare assembly holding element similarly via the link.

Herein, it is preferable to structure the strainer such that the link is formed in an outwardly curved shape, and in accordance with an upward rotation operation of the operating lever, a connection point of the link at its other end to the operating lever moves past a dead point on a virtual line passing through a connection point of the link at its one end to the snare assembly holding element and a pivot point at the pedestal end side of the operating lever, to enter a base element central axis side, whereby a direction of repelling force received from the snare assembly via the link changes, attaining a stable attitude where the operating lever is unreturned.

Further, it is preferable that inside the base element, a guide groove is formed, the guide groove slidably guiding the snare assembly holding element in an engaged state in a vertical direction, an elastic member is protrusively formed inside the guide groove, and a vertically elongated concave groove that receives the elastic member so as to be relatively movable up and down is provided at a side surface of the snare assembly holding element facing the guide groove, wherein as the operating lever is rotated upward to reach a position where the connection point aligns with the dead point, the elastic member abuts on a bottom end wall of the concave groove and deforms, in the stable attitude where the connection point is past the dead point, the elastic member abuts on the bottom end wall of the concave groove in a state where deformation of the elastic member is recovered partially or entirely, and at a lower position where the operating lever is rotated downward and the snare assembly holding element is pushed down, the elastic member abuts on a top end wall of the concave groove.

Still further, it is preferable that inside the base element, the guide groove is formed, the guide groove slidably guiding the snare assembly holding element in an engaged state in the vertical direction, and a vertical groove that communicates with the guide groove and opens toward outside is provided, such that the link rotatively moves inside the vertical groove in accordance with movement of the snare assembly holding element.

Still further, it is preferable that a bracket piece that protrudes toward inside of the vertical groove is formed at a bottom side site of the snare assembly holding element, and the bracket piece has the one end of the link rotatably connected.

Still further, it is preferable that the snare assembly holding element is made up of split components, the split components being:

a snare assembly holding member having the snare assembly stopped at a bottom end side of the snare assembly holding member, and;

a slide member having its exterior shaped so as to be relatively movable upward and downward relative to the snare assembly holding member via a tension adjustment bolt, the slide member having the one end of the link rotatably connected.

Still further, it is preferable that the slide member is structured with a synthetic resin-made member having a substantially inverted-C cross-sectional shape, the slide member having a top wall provided with a through hole into which the tension adjustment bolt is inserted, and with a storage groove opened across one side and a bottom side of the slide member, inside the storage groove opening in the shape of inverted-C, the snare assembly holding member is engaged in a manner relatively movable upward and downward, and the bracket piece having the one end of the link connected is protrusively formed at a side wall of the slide member opposite to the opening one side.

Still further, it is preferable that the tension adjustment bolt penetrating through the through hole of the slide member from above is screwed with the snare assembly holding member, the tension adjustment bolt being provided with a coil spring in a manner interposing between the snare assembly holding member and the slide member so as to bias them away from each other, and rotation of the tension adjustment bolt allows the snare assembly holding member and the slide member to have their up-down relative position fine-tuned.

Furthermore, the present invention provides a snare assembly holding structure, wherein a stopper plate is mounted with a bolt on a snare assembly stopper face of the above-described strainer equipped with a switch mechanism, the bolt being tightened in a state where a snare assembly end is passed through between the snare assembly stopper face and the stopper plate such that the snare assembly end is clamped, characterized in that the stopper plate is provided with a first clamping piece for clamping a tip side of the snare assembly end relative to an insertion position of the bolt, and a second clamping piece for clamping an opposite pedestal end side, interior surfaces of respective clamping pieces facing the snare assembly stopper face are each structured to be one of a flat plane and a curved plane inclined by a degree smaller than 90° toward a same side in a bolt axial direction relative to a virtual plane perpendicular to an axis of the bolt, the snare assembly stopper face has its sites respectively facing the clamping pieces each as one of a flat plane and a curved plane substantially parallel to the interior surfaces of the clamping pieces, axial force obtained by tightening the bolt acts on the interior surfaces of the clamping pieces as force enhanced by a wedge effect, and the enhanced clamping force tightly clamps the snare assembly end between the snare assembly stopper face and the stopper plate.

Furthermore, the present invention provides a snare assembly holding structure, wherein a stopper plate is mounted with a bolt on a snare assembly stopper face of one of a strainer equipped with a switch mechanism for switching a snare assembly between contact and noncontact states and a fixed type strainer, the bolt being tightened in a state where a snare assembly end is passed through between the snare assembly stopper face and the stopper plate such that the snare assembly end is clamped, characterized in that the stopper plate is provided with a first clamping piece for clamping a tip side of the snare assembly end relative to an insertion position of the bolt, and a second clamping piece for clamping an opposite pedestal end side, interior surfaces of respective clamping pieces facing the snare assembly stopper face are each structured to be one of a flat plane and a curved plane inclined by a degree smaller than 90° toward a same side in a bolt axial direction relative to a virtual plane perpendicular to an axis of the bolt, the snare assembly stopper face has its sites respectively facing the clamping pieces each as one of a flat plane and a curved plane substantially parallel to the interior surfaces of the clamping pieces, axial force obtained by tightening the bolt acts on the interior surfaces of the clamping pieces as force enhanced by a wedge effect, and the enhanced clamping force tightly clamps the snare assembly end between the snare assembly stopper face and the stopper plate.

In those snare assembly holding structures, it is preferable that the interior surfaces of the clamping pieces are each formed as a flat plane inclined by a prescribed angle that falls within a range of 35 to 55° toward the same side in the bolt axial direction relative to the virtual plane.

Further, it is preferable that the stopper plate is structured with a center portion into which the bolt is inserted, and a first clamping piece and a second clamping piece each continuously formed from the center portion.

Still further, it is preferable that, among edge portions of the interior surfaces of the clamping pieces, at least an edge portion located in a direction in which the snare assembly end is passed through is provided with an engagement groove for positioning the snare assembly end.

Effect of the Invention

With the strainer according to the present invention structure as described in the foregoing, with a simple structure attained by the operating lever and the link, the switch mechanism can be provided in a cost-effective manner. Further, when the operating lever is rotated upward, the snare assembly holding element can be lifted up in the direction substantially directly above by the link connected to the lever. Thus, being different from a conventional structure in which the element is pushed up diagonally upward by a linkage mechanism, the strainer according to the present invention can easily be operated with small force with no backlash occurring between the snare assembly holding element and the base element, and can maintain excellent operation feel. In a snare assembly contact state, even when the lever is inadvertently moved by a small amount, owing to its great allowance, a noncontact state is not easily be entered and the contact state can stably be maintained. Conversely, when the operating lever is rotated downward, the snare assembly holding element can be pushed down in the direction substantially directly underneath by the link. Thus, as being aided also by gravity, the snare assembly holding element smoothly goes down.

Further, it is structured such that the link is formed in an outwardly curved shape, and in accordance with an upward rotation operation of the operating lever, a connection point of the link at its other end to the operating lever moves past a dead point on a virtual line passing through a connection point of the link at its one end to the snare assembly holding element and a pivot point at the pedestal end side of the operating lever, to enter a base element central axis side, whereby a direction of repelling force received from the snare assembly via the link changes, attaining a stable attitude where the operating lever is unreturned. Therefore, in a snare assembly contact state, even when the operating lever is inadvertently touched during playing, the lever does not easily go down. Hence, the player can concentrate on playing the drum with no anxiety. Also, a great improvement is achieved in both the operation feel and stability when rotating the operating lever upward.

Still further, inside the base element, a guide groove is formed, the guide groove slidably guiding the snare assembly holding element in an engaged state in a vertical direction; an elastic member is protrusively formed inside the guide groove; and a vertically elongated concave groove that receives the elastic member so as to be relatively movable up and down is provided at a side surface of the snare assembly holding element facing the guide groove; wherein, as the operating lever is rotated upward to reach a position where the connection point aligns with the dead point, the elastic member abuts on a bottom end wall of the concave groove and deforms; in the stable attitude where the connection point is past the dead point, the elastic member abuts on the bottom end wall of the concave groove in a state where deformation of the elastic member is recovered partially or entirely; and at a lower position where the operating lever is rotated downward and the snare assembly holding element is pushed down, the elastic member abuts on a top end wall of the concave groove. Accordingly, when the operating lever is turned up and the dead point is exceeded, the snare assembly holding element slightly goes down to enter a stable attitude. On the other hand, because the elastic member abuts on the bottom end wall, it is free of backlash and the musical performance is not adversely affected. Further, because the elastic member deforms at the dead point and thereafter recovers to attain the stable attitude, the operating lever does not go down until the elastic member is deformed again. Accordingly, even when the operating lever is inadvertently touched during playing, the lever does not easily go down. Hence, the player can concentrate on playing the drum with no anxiety.

Also, a further improvement is achieved in both the operation feel and stability when rotating the operating lever upward. Further, also at a lower position where the operating lever is rotated downward, i.e., in a snare assembly noncontact state where the snare assembly holding element is pushed down, because the elastic member abuts on the top end wall, it is free of backlash and the musical performance is not adversely affected.

Still further, it is structured such that: inside the base element, the guide groove is formed, the guide groove slidably guiding the snare assembly holding element in an engaged state in the vertical direction; and a vertical groove that communicates with the guide groove and opens toward outside is provided, such that the link rotatively moves inside the vertical groove in accordance with movement of the snare assembly holding element. As a result, a linkage mechanism that smoothly moves the snare assembly holding element is implemented with a simple structure, and an improvement in its appearance is also achieved.

Still further, a bracket piece that protrudes toward inside of the vertical groove is formed at a bottom side site of the snare assembly holding element; and the bracket piece has the one end of the link rotatably connected. Therefore, the bracket piece and the link connection portion are hidden externally, whereby an excellent appearance can be maintained.

Still further, the snare assembly holding element is made up of split components, the split components being: a snare assembly holding member having the snare assembly stopped at a bottom end side of the snare assembly holding member, and; a slide member having its exterior shaped so as to be relatively movable upward and downward relative to the snare assembly holding member via a tension adjustment bolt, the slide member having the one end of the link rotatably connected. Therefore, a mechanism for fine-tuning the tension after the snare assembly is brought into contact can be implemented by the simple structure in which the members are moved relatively to one another.

Still further, the slide member is structured with a synthetic resin-made member having a substantially inverted-C cross-sectional shape, the slide member having a top wall provided with a through hole into which the tension adjustment bolt is inserted, and with a storage groove opened across one side and a bottom side of the slide member; inside the storage groove opening in the shape of inverted-C, the snare assembly holding member is engaged in a manner relatively movable upward and downward; and the bracket piece having the one end of the link connected is protrusively formed at a side wall of the slide member opposite to the opening one side. Therefore, the synthetic-resin made slide member allows the snare assembly holding element to smoothly move with small frictional resistance relative to the base element, and the relative position of the snare assembly holding member engaging with the storage groove of the slide member can also be fine-tuned smoothly.

Still further, the tension adjustment bolt penetrating through the through hole of the slide member from above is screwed with the snare assembly holding member, the tension adjustment bolt being provided with a coil spring in a manner interposing between the snare assembly holding member and the slide member so as to bias them away from each other; and rotation of the tension adjustment bolt allows the snare assembly holding member and the slide member to have their up-down relative position fine-tuned. Accordingly, when the tension adjustment bolt is rotated, the biasing force of the coil spring allows the tension adjustment bolt, the slide member and the snare assembly holding member to have their upward and downward relative position gradually fine-tuned in a stable integrated attitude without backlash, whereby smooth operation feel can be realized.

Further, with the snare assembly holding structure according to the present invention, it is structured such that: interior surfaces of respective clamping pieces facing the snare assembly stopper face are each structured to be one of a flat plane and a curved plane inclined by a degree smaller than 90° toward a same side in a bolt axial direction relative to a virtual plane perpendicular to an axis of the bolt; and the snare assembly stopper face is also structured to be one of a flat plane and a curved plane being substantially parallel thereto. Accordingly, despite a single stopper plate is used, the clamping force enhanced by the wedge effect makes it possible to tightly clamp the snare assembly end, to prevent loosening, and to firmly support without necessity of providing any projection or the like. Therefore, the present structure is free of braking of the snare assembly end, and with the present structure, tightening adjustment can be carried out easily and attaching work can be done in a simple manner.

Further, the interior surfaces of the clamping pieces are each formed as a flat plane inclined by a prescribed angle that falls within a range of 35 to 55° toward the same side in the bolt axial direction relative to the virtual plane. Therefore, the snare assembly end can surely be held with appropriate clamping force. When the inclination angle is smaller than 35°, the clamping force by the wedge effect is not adequate. On the other hand, when the inclination angle is greater than 55°, the clamping force by the wedge effect becomes excessively great. This narrows the adjustment range of tightening, and invites possible braking of the snare assembly end.

Still further, the stopper plate is structured with a center portion into which the bolt is inserted, and a first clamping piece and a second clamping piece each continuously formed from the center portion. Therefore, it may be formed by bending one plate. Thus, a well-balanced structure having a simple structure while being able to prevent an increase in costs is achieved.

Still further, among edge portions of the interior surfaces of the clamping pieces, at least an edge portion located in a direction in which the snare assembly end is passed through is provided with an engagement groove for positioning the snare assembly end. Therefore, by positioning the snare assembly end at the engagement groove, it becomes possible to hold the snare assembly end with previously expected clamping force. This makes it possible to prevent unnecessary load on the snare assembly end, and makes the attaching work easier.

BEST MODE FOR CARRYING OUT THE INVENTION

Next, a detailed description will be given of embodiments of the present invention, referring to the drawings.

FIG. 1 is a perspective view showing an overall structure of a strainer equipped with a switch mechanism according to the present invention. FIG. 3 is an explanatory drawing showing a usage state where the strainer is mounted on a drum shell body. FIGS. 1 to 9 show a first embodiment. FIGS. 10 to 16 show a second embodiment. FIGS. 18 to 22 show a third embodiment. In the drawings, the reference numeral 1 denotes a strainer; 2 denotes a base element; 3 denotes a snare assembly holding element; 4 denotes an operating lever; and 5 denotes a link.

First, referring to FIGS. 1 to 9, a description will be given of the first embodiment.

As shown in FIGS. 1 to 3, a strainer 1 includes a base element 2 that is fixed on a shell body 100 side of a drum; a snare assembly holding element 3 that is engaged with the base element 2 to freely slide up and down, and that has its bottom end side connected to a snare assembly 102; and an operating lever 4 that slides up and down the snare assembly holding element 3 relative to the base element 2, so as to switch the snare assembly 102 between contact/noncontact states relative to a drumhead 101.

As can also be seen from FIGS. 5 and 9, the present invention is characterized in further including a link 5 that pivotally and rotatably support a pedestal end of the operating lever 4 on the base element 2 via a shaft portion 60, the link 5 having its one end 5*a* rotatably connected to a site located lower than the shaft portion 60 of the operating lever 4 in the snare assembly holding element 3, and having its other end 5*b* also rotatably connected to a midway position away by a prescribed distance toward a tip end from the pedestal end portion 40 of the operating lever 4. The present invention is also characterized in the following configuration: starting from the state shown in FIG. 9, upward rotation of the operating lever 4 lifts up the snare assembly holding element 3 relative to the base element 2 via the link 5; and conversely, starting from the state shown in FIG. 5, downward rotation of the operating lever 4 pushes down the snare assembly holding element 3 similarly via the link 5.

It is noted that the strainer 1 according to the present invention can widely be used in conjunction with conventional snare drums. It may be directly mounted on the drum shell body as in the present embodiment, or it may be implemented as a floating type, i.e., disposed to be away from the shell body. Also, the snare assembly (snare wires) held by the strainer 1 may generally be any one of those conventional known snare assemblies. In the present embodiment, as shown in FIG. 3, a plurality of snare wires 104 made up of metal coils or the like is arranged in parallel to one another between a pair of snare mounting plates 103, wherein tapes or strings 105 attached to the snare mounting plates 103 are each drawn through a slit opened at a hoop 106 at the rim of the drumhead, and stopped at the bottom end portion of the snare assembly holding element 3. That is, what is exemplarily shown is the "internal contact" type in which the snare mounting plates 103 together with the snare wires 104 contact the bottom-side drumhead 101, there are no limitations as to the structure of the snare assembly and how to stretch the snare assembly. Accordingly, it may be the "full contact" type in which ends of the snare wires and the snare mounting plates are drawn outside the hoop.

As can also be seen from FIG. 8, the base element 2 is structured by coupling halved metal split housings 20 and 21. In the interior resulted by the coupling, a guide groove 22 is formed so as to slidably guide the snare assembly holding element 3 in an engaged state in the vertical direction. Also formed is a vertical groove 23 that communicates with the guide groove 22 and opens toward the outside, in which the link 5 rotatively moves therein in accordance with upward and downward movement of the snare assembly holding element 3. While the base element 2 is made of metal herein, it may be structured with resin or any other material so long as it has a certain strength. It goes without saying that the base element 2 may have a structure other than the halved split housings, such as a structure made up of a case body and a lid, or any other structure.

As shown in FIG. 6, cylindrical portions 24 and 25 are protrusively and inwardly formed at upper positions facing each other in the groove interior walls of respective split housings 20 and 21 structuring the vertical groove 23. The split housings 20 and 21 are coupled to each other by a mounting bolt 27 that penetrates from the split housing 20 through the cylindrical portions 24 and 25, to be screwed with the other split housing 21 and other bolts 27A and 27B. Additionally, within a concave portion 28 that is formed in a stepwise manner at the tip opening portion of the cylindrical portion 24, a cylindrical slide portion 26 on the pedestal end side of the operating lever 4 is engageably inserted so as to be interposed between the cylindrical portions 24 and 25. In this manner, the shaft portion 60 that pivotally and rotatably supports the pedestal end side of the operating lever 4 is structured. While the shaft portion 60 structured in this manner allows the operating lever 4 to rotate stably and smoothly, the shaft portion 60 may be provided at a location other than inside the vertical groove 23, and may be provided outside the base element 2, for example.

The snare assembly holding element 3 is made up of split components, namely: a snare assembly holding member 7 provided on its bottom end side with a snare assembly stopper portion 70 for stopping a snare assembly string 105; and a slide member 8 having its exterior shaped so as to be relatively movable upward and downward relative to the snare assembly holding member via a tension adjustment bolt 71, the one end of the link being rotatably connected to the slide member 8. With this structure, in a state where the snare assembly is brought into contact with the drumhead by manipulation of the operating lever 4, the tension adjustment bolt 71 can further be rotated to thereby fine-tune the tension of the snare assembly.

The snare assembly holding member 7 is structured to be in a substantially T shape, wherein a substantially rectangular shaped body made of metal is provided at its bottom end with the snare assembly stopper portion 70 extending right and left sides. To the snare assembly stopper portion 70, a stopper plate 76 for clamping and stopping the snare assembly string is fixed by two tightening square-headed bolts 77. Further, a bottomed bolt insert hole 72 into which the tension adjustment bolt 71 is axially inserted from above is formed. Inside the bottomed bolt insert hole 72, a nut 75 with which the tension adjustment bolt 71 is screwed is attached by insertion, wherein the tension adjustment bolt 71 penetrates from above through a top wall 80 of the slide member 8, which will be described later. It may be structured with synthetic resin or any other material so long as it has a strength enough to hold the snare assembly.

More specifically, at a top end opening portion of the bolt insert hole 72, a first large diameter space S1 is formed, to which a first coil spring 73 is attached, which abuts on the interior surface of the top wall 80 of the opposing slide member 8 so as to bias the snare assembly holding member 7 and the slide member 8 to be away from each other. Further, at a midway portion, a second large diameter space S2 is formed to open sideways, to which the nut 75 can unrotatably be attached and to which a second coil spring 74 that upwardly biases the nut 75 is attached. Thus, it is structured such that, when the tension adjustment bolt 71 is rotated, the biasing force of the coil springs 73 and 74 allows the tension adjustment bolt 71, the slide member 8 and the snare assembly holding member 7 to have their upward and downward relative position gradually fine-tuned, in a stable integrated attitude without backlash. It is noted that the nut 75 can be dispensed with, and instead, a female screw portion with which the tension adjustment bolt 71 is directly screwed may be formed at the bolt insert hole 72.

On the other hand, the slide member 8 is a synthetic resin compact, which is provided with a storage groove 81 opening across one side and the bottom side so as to have a substantially inverted-C cross-sectional shape. Bored at the top wall 80 of the slide member 8 is a through hole 80*a* for passing through the tension adjustment bolt 71 from above, wherein the tension adjustment bolt 71 screws with the snare assembly holding member 7 engaged inside the storage groove 81. Protrusively formed at a bottom side site of a side wall 82 of the slide member 8 opposite to the opening one side is a bracket piece 83 to which the link 5 has its one end 5*a* connected. Thus, the bracket piece 83 and at least one end of the link 5 move up and down inside the vertical groove 23 of the base element 2. While the slide member 8 may be structured with metal or any other material, it is preferable to be made of synthetic resin as in the present embodiment, so as to achieve a reduction in weight and an improvement in sliding performance with respect to the base element 2.

Formed at the midway positions of the bracket piece 83 of the slide member 8 and the operating lever 4 are shaft portions 61 and 62, on which the one end 5*a* and the other end 5*b* of the link 5 are rotatably pivoted, respectively. The shaft portions 61 and 62 are protrusively formed in two directions so as to each form a T-shape with the bracket piece 83 and the operating lever 4, respectively. Here, the link 5 is provided as two outwardly curved identical shaped members so as to each connect between the shaft portions protruding on the same side. The link 5 may be structured in a manner other than the two-member structure, and it may be structured with one single member or it may be structured with three or more members.

Because the link 5 is formed in an outwardly curved shape as described above, when the operating lever 4 is rotated upward, the connection point (the shaft portion 62) of the link other end 5*b* to the operating lever 4 moves past a dead point on a virtual line to enter the base element central axis side, the virtual line being a line passing through the connection point (the shaft portion 61) of the link one end 5*a* to the bracket piece 83 and the shaft portion 60 being a pivot point on the operating lever pedestal end side. This causes the direction of the repelling force received from the snare assembly 102 via the link 5 to change. Thus, the stable attitude where the operating lever 4 is unreturned is attained. This is achieved by the curved shape of the link 5 which allows the link 5 to escape without being abutting on the shaft portion 60. However, this can also be achieved by other shape except for the curved shape, and it may be a dogleg shape, or a shape that allows the shaft portion 60 to escape, e.g., a shape with a groove and the like.

On the exterior surface side of the split housing 20 of the base element 2, a mount 29 is integrally provided. By inserting a mounting screw 107 from the interior surface side into a through hole 100*a* formed at the shell body 100 so as to screw with a screw hole 29*a* of the mount 29, and hence, the base element 2, or the strainer 1 is fixed onto the surface of the shell body 100. At the symmetrical position attained by a 180-degree rotation of the strainer 1 about the drumhead center, a strainer 11 having no switch mechanism or the like as shown in FIG. 4 is similarly fixed onto the surface of the shell body 100. To the snare assembly stopper portion 70 of the strainer 1 and a similar stopper portion structured at the strainer 11, the snare assembly strings 105 at both ends of the snare assembly 102 drawn out from the slits of the hoop 106 are stopped, whereby the snare assembly 102 is stretched across the surface of the drumhead 101. As has been described in the foregoing, in the present embodiment, while the strainer 1 is structured to serve the purpose of switching the snare assembly between contact/noncontact states and fine-tuning of the snare assembly, it is also possible to provide the strainer 11 with the fine-tune function, or to replace the strainer 11 with another strainer 1.

In the present embodiment, the tension state (contact/noncontact) of the snare assembly 102 is switched by the operating lever 4 of the strainer 1 arranged on one side. When playing without using the sound effect of the snare assembly 102, the player should move the snare assembly holding member 7 downward by the operating lever 4, such that the noncontact state relative to the drumhead 101 is entered. When it is desired to use the sound effect, the player should move the snare assembly holding member 7 upward by the operating lever 4 so as to increase the tension of the snare assembly 102, so as to bring the snare assembly 102 into contact with the drumhead 101. In this contact state, by further rotating the tension adjustment bolt 71 to fine-tune the up and down position of the snare assembly holding member 7, the fine tension adjustment of the snare assembly 102 can be carried out.

Next, referring to FIGS. 10 to 16, a description will be given of the second embodiment.

In connection with the second embodiment, the description will mainly be given of a snare assembly holding structure according to the present invention. FIG. 10 is a partial cross-sectional view showing a snare drum in which a snare assembly is held by a pair of strainers 1 and 11. In the drawing, the reference numeral 1 denotes a strainer equipped with a switch mechanism; 11 denotes a fixed type strainer; 100 denotes a drum shell body; 102 denotes a snare assembly; 105 denotes a snare assembly string at the snare assembly end; and St denotes a snare assembly holding structure. In the present embodiment, while the one strainer 1 is equipped with a switch mechanism and the other strainer 11 is of a fixed type, as in the conventional ones, both of the strainers may each be equipped with a switch mechanism. Further, in connection with the present embodiment, while the description will be given of an exemplary case where the snare assembly holding structure St according to the present invention is applied to each of the strainers 1 and 11, it goes without saying that it is possible to apply the holding structure St of the present invention to one of them solely, while any conventional holding structure is applied to the other.

As shown in FIGS. 10 and 11, the strainer 1 is a strainer equipped with a switch mechanism that includes: a base element 2 that is fixed on a shell body 100 side of a drum; a snare assembly holding element 3 that is engaged with the base element 2 to freely slide up and down, and that has its bottom end side connected to a snare assembly 102; and an operating lever 4 that slides up and down the snare assembly holding element 3 relative to the base element 2, so as to switch the snare assembly 102 between contact/noncontact states relative to the drumhead 101. Because the basic structure of the base element 2 and the like and the operation of the switch mechanism is the same as in the first embodiment and, therefore, the description thereof is not repeated herein.

Each snare assembly holding structure St is structured as follows: a stopper plate 76 is mounted on a snare assembly stopper face 30 of a snare assembly stopper portion 70 of the strainer 1 (11) with a bolt 77, and the bolt 77 is tightened in a state where a snare assembly end 105 is passed through between the snare assembly stopper face 30 and the stopper plate 76, whereby the snare assembly end 105 is clamped therebetween. As shown in FIGS. 13 and 14, the stopper plate 76 is structured with a center portion 33 through which the bolt 77 is inserted, and a first clamping piece 31 and a second clamping piece 32 each continuously formed from the center portion 33. The tip end side of the snare assembly end 105 relative to a bolt insert position (bolt insert holes 34) is clamped by the first clamping piece 31, and the opposite pedestal end side is clamped by the second clamping piece 32.

Interior surfaces 31*a* and 32*a* of respective clamping pieces 31 and 32 facing the snare assembly stopper face 30 are each structured as a flat or curved plane inclined by a degree smaller than 90° toward the same side in the bolt axial direction (in the present embodiment, the direction in which the bolt is inserted) relative to a virtual plane 35 perpendicular to the bolt axis (in the present embodiment, the interior surfaces 31*a* and 32*a* are flat planes respectively having inclination angles $\alpha$1 and $\alpha$2). Conforming to the shape of the interior surfaces of the clamping pieces 31 and 32, the sites of the snare assembly stopper face 30 facing the clamping pieces 31 and 32 are also structured as flat or curved planes substantially parallel to the interior surfaces 31*a* and 32*a* of the clamping pieces, respectively. In the gap between such parallel elements, the snare assembly end 105 is clamped with uniform force. In particular, the axial force (P) obtained by tightening the bolt 77 acts on the interior surfaces 31*a* and 32*a* of the clamping pieces as force (P') that is enhanced by the wedge effect. By the enhanced clamping force (P'), the snare assembly end 105 is tightly clamped between the snare assembly stopper face 30 and the stopper plate 76.

Preferably, the interior surfaces 31*a* and 32*a* of the clamping pieces are each formed as a flat plane inclined by a prescribed angle that falls within a range of 35 to 55° toward the same side in the bolt axial direction relative to the virtual plane 35. Preferably, the inclination angles of the interior surfaces 31*a* and 32*a* are substantially the identical angle. This allows the clamping force to be uniform, prevents uneven force from acting on each snare assembly end, and provides easier adjustment in tightening the bolt. In the present embodiment, the angles are both set to approximately 45°. Among the edge portions of the interior surfaces 31*a* and 32*a* of the clamping pieces, at least the edge portions located in the direction in which the snare assembly end is passed through are provided with engagement grooves 36 for positioning the snare assembly end 105. Because the distance between the two snare assembly strings structuring the snare assembly end 105 varies in accordance with the width of the snare assembly, in the present embodiment, as can be seen from FIG. 13, the engagement grooves 36 for engaging the two snare assembly strings are formed as two pairs of engagement grooves 36 respectively forming a wide width set and a narrow width set.

FIG. 15 (*a*) shows a variation of the mounting position of the stopper plate 76. In the representative embodiment having been described in the foregoing, in the snare assembly stopper portion 70 of the snare assembly holding member 7, the shape of the corner portion at the front surface and the bottom surface is adopted as the snare assembly stopper face 30 so as to mount the stopper plate 76 thereon. In contrast, in the present variation, a stopper face 30 having an angle cross section is structured at the front surface of the snare assembly stopper portion 70, and the stopper plate 76 is mounted on the front surface side. In particular, with this structure, the snare assembly end 105 protruding from the bottom edge of the second clamping piece 32 forms no angle, whereby a reduction in the burden on the snare assembly end 105 can advantageously be achieved.

FIG. 15 (*b*) shows a variation in which the interior surfaces 31*a* and 32*a* of the clamping pieces are each structured as a flat plane inclined in the bolt removal direction (bolt head portion direction) in the bolt axial direction. With such a structure also, the force enhanced by the wedge effect acts on the interior surfaces 31*a* and 32*a* of the clamping pieces, whereby the snare assembly end 105 is tightly clamped between the snare assembly stopper face 30 and the stopper plate 76. FIGS. 16 (*a*) to 16 (*c*) each show a variation in which the interior surfaces 31*a* and 32*a* of the clamping pieces are each structured as a curved plane inclined by a degree smaller than 90° toward the same side in the bolt axial direction. With such curved planes also, the force enhanced by the wedge effect acts, whereby the snare assembly end 105 is tightly clamped between the snare assembly stopper face 30 and the stopper plate 76. In particular, with such curved planes, the nearer a location in the clamping pieces 31 and 32 relative to the edge portions thereof where the snare assembly end is passed through, the greater each angle of aforementioned inclination and the force exerted. Hence, it becomes possible to clamp the snare assembly end 105 such that it hardly comes off.

As shown in FIG. 10, similarly to the mount of the strainer 1, the fixed type strainer 11 is structured with: a snare assembly stopper portion 70 that is fixed on the surface of the shell body 100 by inserting a mounting screw 107 from the interior surface side into a through hole 100*a* formed at the shell body 100; and a stopper plate 76 mounted on the front surface of the snare assembly stopper portion 70. A snare assembly holding structure St with the stopper plate 76 is, as shown in the cross-sectional view of FIG. 14 (*b*), identical to the snare assembly holding structure with the strainer 1 described in the foregoing, and the principle holds true for its variations (exemplary variations shown in FIGS. 15 and 16). Therefore, the identical reference numerals are allotted to the identical structures, and the description thereof is not repeated herein.

In the present embodiment, the tension state (contact/noncontact) of the snare assembly 102 is switched by the operating lever 4 of the strainer 1 arranged on one side. When playing without using the sound effect of the snare assembly 102, the player should move the snare assembly holding member 7 downward by the operating lever 4, such that the noncontact state relative to the drumhead 101 is entered. When it is desired to use the sound effect, the player should move the snare assembly holding member 7 upward by the operating lever 4 so as to increase the tension of the snare assembly 102, so as to bring the snare assembly 102 into contact with the drumhead 101. In this contact state, by further rotating the tension adjustment bolt 71 to fine-tune the up and down position of the snare assembly holding member 7, the fine tension adjustment of the snare assembly 102 can be carried out.

Next, referring to FIGS. 18 to 22, a description will be given of the third embodiment.

The present embodiment is another embodiment of the strainer 1 equipped with a switch mechanism, wherein, as shown in FIG. 18, an elastic member 92 is protrusively formed toward the snare assembly holding element 3 inside the guide groove 22 that slidably guides the snare assembly holding element 3, and a vertically elongated concave groove 85 that receives the elastic member 92 so as to be relatively movable up and down is provided at a side surface of the snare assembly holding element 3 facing the guide groove 22. More specifically, as shown in FIGS. 20 and 21, a fit hole 90 into which the elastic member 92 is partially protrusively fit is formed at the bottom surface of the guide groove 22 on the split housing 20 side, and by a screw 93 that screws with a screw hole 91 formed at the fit hole 90, the elastic member 92 is fixed to the fit hole 90. Further, the concave groove 85 is formed at a side surface of the slide member 8 structuring the snare assembly holding element 3, whereby the snare assembly holding element 3 moves up and down in a state where the elastic member 92 is received inside the concave groove 85. Preferably, a member made of rubber or thermoplastic elastomer is used as the elastic member 92. On the other hand, it may be any other member made of material other than that so long as it elastically deforms, such as synthetic resin foam, leather, fibers and the like.

When the operating lever 4 is rotated upward to reach the position where the connection point (the shaft portion 62) aligns with a dead point on a virtual line that passes through a connection point (the shaft portion 61) of the link one end to the bracket piece 83 and the shaft portion 60 being a pivot point on the operating lever pedestal end side, as shown in FIG. 22 (*a*), the elastic member 92 abuts on the concave groove bottom end wall 85*b* and deforms. Further, in the stable attitude where the connection point (the shaft portion 62) is past the dead point, as shown in FIG. 22 (*b*), the elastic member 92 abuts on the concave groove bottom end wall 85*b* in a state where deformation of the elastic member 92 is recovered partially or entirely. Thus, in the stable attitude, the musical performance is not affected by any backlash. Further, because the operating lever 4 does not go down until the elastic member 92 is deformed again, the lever is not lowered easily even when the player inadvertently touches the operating lever while playing the drum. It is noted that, in the present embodiment, at the snare assembly holding element 3, more specifically, at an upper position of the side wall 82 of the slide member 8, an elastic element 84 that abuts on the operating lever 4 or the link other end 5*b* in the stable attitude is protrusively formed. Such a structure prevents backlash of the operating lever 4 itself or the link 5 itself in the stable attitude, and hence prevents any adverse effect to the musical performance.

At the lower position where the operating lever 4 is rotated downward and the snare assembly holding element 3 is pushed down, as shown in FIG. 22 (*c*), the elastic member 92 abuts on a concave groove top end wall 85*a*, whereby no backlash occurs and the musical performance is not adversely affected. The structure of other parts and variations of the present embodiment are basically similar to those of the first embodiment and, therefore, the identical reference numerals are allotted to the identical structures, and the description thereof is not repeated herein.

While the embodiments of the present invention have been described in the foregoing, the present invention is not limited thereto. For example, it goes without saying that the present invention can be practiced in various modes within a range not deviating from the gist of the present invention, for example, by disposing the operating lever outwardly, instead of disposing the same laterally in parallel to the shell body surface.

BRIEF DESCRIPTION OF DRAWINGS

FIG. 1 is a perspective view showing a strainer according to a first embodiment of the present invention.

FIG. 2 is an elevation view of the strainer.

FIG. 3 is an explanatory drawing of the usage state of the strainer.

FIG. 4 is a plan view of the strainer holding other end of a snare assembly.

FIG. 5 is a right to left vertical cross-sectional view of the strainer.

FIG. 6 is a front to rear vertical cross-sectional view of the strainer.

FIG. 7 is a perspective view of a snare assembly holding element of the strainer.

FIG. 8 is a horizontal cross-sectional view of the strainer.

FIG. 9 is a right to left vertical cross-sectional view of the strainer in a state where an operating lever is lowered.

FIG. 10 is an explanatory drawing of an overall structure of a snare assembly holding structure according to a second embodiment of the present invention.

FIG. 11 is a perspective view of the strainer equipped with a switch mechanism.

FIG. 12 is a front to rear vertical cross-sectional view of the strainer.

FIG. 13(*a*) is an elevation view of a stopper plate. FIG. 13 (*b*) is a cross-sectional view of the same.

FIGS. 14(*a*) and (*b*) are cross-sectional views of substantial part of the snare assembly holding structure.

FIGS. 15(*a*) and (*b*) are cross-sectional views of variations of the snare assembly holding structure.

FIGS. 16(*a*) to (*c*) are cross-sectional views of even more variations of the snare assembly holding structure.

FIGS. 17(*a*) and (*b*) are cross-sectional views of substantial part showing a conventional exemplary snare assembly holding structure.

FIG. 18 is a front to rear vertical cross-sectional view of a strainer according to a third embodiment of the present invention.

FIG. 19 is a right to left vertical cross-sectional view of the strainer.

FIG. 20 is a horizontal cross-sectional view of the strainer.

FIG. 21 is an exploded perspective view of a slide member and a split housing of the strainer.

FIGS. 22(*a*) to (*c*) are explanatory drawings showing the action of an elastic member when an operating lever of the strainer is rotated upward and downward.

The invention claimed is:

1. A strainer, comprising:

a base element that is fixed on a shell body side of a drum;

a snare assembly holding element that is engaged with the base element to freely slide up and down, and that has its bottom end side connected to a snare assembly;

an operating lever that slides up and down the snare assembly holding element relative to the base element, so as to switch the snare assembly between contact and noncontact states relative to a drumhead, characterized in that the strainer further comprises a link that pivotally and rotatably support a pedestal end side of the operating lever on the base element via a shaft portion, the link having its one end rotatably connected to a site located lower than the shaft portion of the operating lever in the snare assembly holding element, the link having its other end also rotatably connected to a midway position away by a prescribed distance toward a tip end from the pedestal end portion of the operating lever, wherein upward rotation of the operating lever lifts up the snare assembly holding element relative to the base element via the link, and downward rotation of the operating lever pushes down the snare assembly holding element similarly via the link.

2. The strainer according to claim 1, wherein the link is formed in an outwardly curved shape, and in accordance with an upward rotation operation of the operating lever, a connection point of the link at its other end to the operating lever moves past a dead point on a virtual line passing through a connection point of the link at its one end to the snare assembly holding element and a pivot point at the pedestal end side of the operating lever, to enter a base element central axis side, whereby a direction of repelling force received from the snare assembly via the link changes, attaining a stable attitude where the operating lever is unreturned.

3. The strainer according to claim 2, wherein
inside the base element,
a guide groove is formed, the guide groove slidably guiding the snare assembly holding element in an engaged state in a vertical direction,
an elastic member is protrusively formed inside the guide groove, and
a vertically elongated concave groove that receives the elastic member so as to be relatively movable up and down is provided at a side surface of the snare assembly holding element facing the guide groove, wherein
as the operating lever is rotated upward to reach a position where the connection point aligns with the dead point, the elastic member abuts on a bottom end wall of the concave groove and deforms,
in the stable attitude where the connection point is past the dead point, the elastic member abuts on the bottom end wall of the concave groove in a state where deformation of the elastic member is recovered partially or entirely, and
at a lower position where the operating lever is rotated downward and the snare assembly holding element is pushed down, the elastic member abuts on a top end wall of the concave groove.

4. The strainer according to claim 3, wherein
inside the base element,
the guide groove is formed, the guide groove slidably guiding the snare assembly holding element in an engaged state in the vertical direction, and
a vertical groove that communicates with the guide groove and opens toward outside is provided, such that the link rotatively moves inside the vertical groove in accordance with movement of the snare assembly holding element.

5. The strainer according to claim 4, wherein
a bracket piece that protrudes toward inside of the vertical groove is formed at a bottom side site of the snare assembly holding element, and
the bracket piece has the one end of the link rotatably connected.

6. The strainer according to claim 5, wherein
the snare assembly holding element is made up of split components, the split components being:
a snare assembly holding member having the snare assembly stopped at a bottom end side of the snare assembly holding member, and;
a slide member having its exterior shaped so as to be relatively movable upward and downward relative to the snare assembly holding member via a tension adjustment bolt, the slide member having the one end of the link rotatably connected.

7. The strainer according to claim 6, wherein
the slide member is structured with a synthetic resin-made member having a substantially inverted-C cross-sectional shape, the slide member having a top wall provided with a through hole into which the tension adjustment bolt is inserted, and with a storage groove opened across one side and a bottom side of the slide member,
inside the storage groove opening in the shape of inverted-C, the snare assembly holding member is engaged in a manner relatively movable upward and downward, and
the bracket piece having the one end of the link connected is protrusively formed at a side wall of the slide member opposite to the opening one side.

8. The strainer according to claim 7, wherein
the tension adjustment bolt penetrating through the through hole of the slide member from above is screwed with the snare assembly holding member, the tension adjustment bolt being provided with a coil spring in a manner interposing between the snare assembly holding member and the slide member so as to bias them away from each other, and
rotation of the tension adjustment bolt allows the snare assembly holding member and the slide member to have their up-down relative position fine-tuned.

9. A snare assembly holding structure, wherein a stopper plate is mounted with a bolt on a snare assembly stopper face of the strainer according to claim 8, the bolt being tightened in a state where a snare assembly end is passed through between the snare assembly stopper face and the stopper plate such that the snare assembly end is clamped, characterized in that
the stopper plate is provided with a first clamping piece for clamping a tip side of the snare assembly end relative to an insertion position of the bolt, and a second clamping piece for clamping an opposite pedestal end side,
interior surfaces of respective clamping pieces facing the snare assembly stopper face are each structured to be one of a flat plane and a curved plane inclined by a degree smaller than 90° toward a same side in a bolt axial direction relative to a virtual plane perpendicular to an axis of the bolt,
the snare assembly stopper face has its sites respectively facing the clamping pieces each as one of a flat plane and a curved plane substantially parallel to the interior surfaces of the clamping pieces,
axial force obtained by tightening the bolt acts on the interior surfaces of the clamping pieces as force enhanced by a wedge effect, and
the enhanced clamping force tightly clamps the snare assembly end between the snare assembly stopper face and the stopper plate.

10. The snare assembly holding structure according to claim 9, wherein the interior surfaces of the clamping pieces are each formed as a flat plane inclined by a prescribed angle that falls within a range of 35 to 55° toward the same side in the bolt axial direction relative to the virtual plane.

11. The strainer according to claim 1, wherein
inside the base element,
the guide groove is formed, the guide groove slidably guiding the snare assembly holding element in an engaged state in the vertical direction, and
a vertical groove that communicates with the guide groove and opens toward outside is provided, such that the link rotatively moves inside the vertical groove in accordance with movement of the snare assembly holding element.

12. The strainer according to claim 11, wherein
a bracket piece that protrudes toward inside of the vertical groove is formed at a bottom side site of the snare assembly holding element, and
the bracket piece has the one end of the link rotatably connected.

13. The strainer according to claim 12, wherein
the snare assembly holding element is made up of split components, the split components being:
a snare assembly holding member having the snare assembly stopped at a bottom end side of the snare assembly holding member, and;
a slide member having its exterior shaped so as to be relatively movable upward and downward relative to the snare assembly holding member via a tension adjustment bolt, the slide member having the one end of the link rotatably connected.

14. The strainer according to claim 12, wherein the slide member is structured with a synthetic resin-made member having a substantially inverted-C cross-sectional shape, the slide member having a top wall provided with a through hole into which the tension adjustment bolt is inserted, and with a storage groove opened across one side and a bottom side of the slide member, inside the storage groove opening in the shape of inverted-C, the snare assembly holding member is engaged in a manner relatively movable upward and downward, and the bracket piece having the one end of the link connected is protrusively formed at a side wall of the slide member opposite to the opening one side.

15. The strainer according to claim 12, wherein the tension adjustment bolt penetrating through the through hole of the slide member from above is screwed with the snare assembly holding member, the tension adjustment bolt being provided with a coil spring in a manner interposing between the snare assembly holding member and the slide member so as to bias them away from each other, and rotation of the tension adjustment bolt allows the snare assembly holding member and the slide member to have their up-down relative position fine-tuned.

16. A snare assembly holding structure, wherein a stopper plate is mounted with a bolt on a snare assembly stopper face of the strainer according to claim 12, the bolt being tightened in a state where a snare assembly end is passed through between the snare assembly stopper face and the stopper plate such that the snare assembly end is clamped, characterized in that the stopper plate is provided with a first clamping piece for clamping a tip side of the snare assembly end relative to an insertion position of the bolt, and a second clamping piece for clamping an opposite pedestal end side, interior surfaces of respective clamping pieces facing the snare assembly stopper face are each structured to be one of a flat plane and a curved plane inclined by a degree smaller than 90° toward a same side in a bolt axial direction relative to a virtual plane perpendicular to an axis of the bolt, the snare assembly stopper face has its sites respectively facing the clamping pieces each as one of a flat plane and a curved plane substantially parallel to the interior surfaces of the clamping pieces, axial force obtained by tightening the bolt acts on the interior surfaces of the clamping pieces as force enhanced by a wedge effect, and the enhanced clamping force tightly clamps the snare assembly end between the snare assembly stopper face and the stopper plate.

17. A snare assembly holding structure, wherein a stopper plate is mounted with a bolt on a snare assembly stopper face of one of a strainer equipped with a switch mechanism for switching a snare assembly between contact and noncontact states and a fixed type strainer, the bolt being tightened in a state where a snare assembly end is passed through between the snare assembly stopper face and the stopper plate such that the snare assembly end is clamped, characterized in that the stopper plate is provided with a first clamping piece for clamping a tip side of the snare assembly end relative to an insertion position of the bolt, and a second clamping piece for clamping an opposite pedestal end side, interior surfaces of respective clamping pieces facing the snare assembly stopper face are each structured to be one of a flat plane and a curved plane inclined by a degree smaller than 90° toward a same side in a bolt axial direction relative to a virtual plane perpendicular to an axis of the bolt, the snare assembly stopper face has its sites respectively facing the clamping pieces each as one of a flat plane and a curved plane substantially parallel to the interior surfaces of the clamping pieces, axial force obtained by tightening the bolt acts on the interior surfaces of the clamping pieces as force enhanced by a wedge effect, and the enhanced clamping force tightly clamps the snare assembly end between the snare assembly stopper face and the stopper plate.

18. The snare assembly holding structure according to claim 17, wherein the interior surfaces of the clamping pieces are each formed as a flat plane inclined by a prescribed angle that falls within a range of 35 to 55° toward the same side in the bolt axial direction relative to the virtual plane.

19. The snare assembly holding structure according to claim 18, wherein the stopper plate is structured with a center portion into which the bolt is inserted, and a first clamping piece and a second clamping piece each continuously formed from the center portion.

20. The snare assembly holding structure according to claim 19, wherein, among edge portions of the interior surfaces of the clamping pieces, at least an edge portion located in a direction in which the snare assembly end is passed through is provided with an engagement groove for positioning the snare assembly end.

* * * * *